United States Patent [19]

Stevens et al.

[11] Patent Number: 4,845,854

[45] Date of Patent: Jul. 11, 1989

[54] PARALLEL ACTION DIE CUTTING HAND TOOL

[76] Inventors: Bruce W. Stevens; Jeffrey G. Johnson, both of Rt. 2, Rowe #141, Denton, Tex. 76201

[21] Appl. No.: 168,271

[22] Filed: Mar. 15, 1988

[51] Int. Cl.[4] ..... B26B 13/00

[52] U.S. Cl. ..... 30/227; 30/241

[58] Field of Search ..... 30/178, 193, 229, 239, 30/241

[56] References Cited

U.S. PATENT DOCUMENTS 1,231,020 6/1917 Hayes ..... 30/178 X 4,272,888 6/1981 Hartmeister ..... 30/229

*Primary Examiner*—Douglas D. Watts

*Attorney, Agent, or Firm*—Michael A. O'Neil

[57] ABSTRACT

An improved parallel action die cutting hand tool having a pair of scissors-action handle levers pivoted on a transverse pivot axis, so that the handle levers operate in a plane. The hand tool includes first and second die cutting jaws connected to the handle levers for parallel movement toward and away from each other. The hand tool has a pair of guide pins extending between the die cutting jaws and slidable with respect to at least one of the jaws. Each pin lies outside of and parallel to the plane of the handle levers. A die plate, held on one of the jaws by a pair of ribs, has curved corners that meet the ribs at a tangent angle of substantially zero degrees. In an alternate embodiment of the invention, the guide pins are spaced apart, lying in the plane of the handle levers, and located on opposite sides of the cutting edges. In another alternate embodiment, there is a single guide pin only, lying in the plane of the handle levers and located approximately midway between the forward pivot pins and the transverse pivot axis.

8 Claims, 4 Drawing Sheets

PARALLEL ACTION DIE CUTTING HAND TOOL

TECHNICAL FIELD

This invention relates in general to parallel action die cutting hand tools. In particular, the invention relates to hand-operated cutting tools adapted to trim sheet materials, such as venetian blind slats.

BACKGROUND AND SUMMARY OF THE INVENTION

Venetian blind trimmers are used to adapt a premanufactured blind to the specific requirements of an opening by trimming one end of each slat. For this purpose, cutting dies are attached to the jaws of a scissors-action hand tool similar to a tin snip. A depth gauge is connected to one of the dies to provide a uniform measurement for evenly modifying the length of each slat. The typical scissors-action venetian blind trimmer brings the dies together with a variable shear so that a slat is trimmed progressively from one edge to the other as the pivoted handles of the trimmer are closed. An ordinary shear cannot be used for this trimming operation because venetian blind slats have curved corners. These curved corners must be preserved for cosmetic uniformity among slats of a single blind.

The task of trimming venetian blind slats with acceptable uniformity presents several problems. First, the slats are slightly bowed from front to rear and tend to flatten under the pressure of a cutting tool, presenting an alignment problem between the slats and the cutting dies. Second, the slats are constructed from thin sheet material, such as aluminum, so the edges are subject to burring if the clearance between the dies is excessive. Burring is a recurrent problem with scissors-action trimmers, since alignment between the dies is controlled only at the single pivot point between the shear handles. If either burring or an uneven corner results from a trimming operation, it is necessary to retrim or to replace the slat. Retrimming one slat may produce an unevenness among the slats. Therefore, it is highly desirable for a trimmer to be accurate and consistent in its operation.

U.S. Pat. No. 4,272,888 to Hartmeister discloses a parallel action die cutting hand tool having a pair of scissors-action handle levers pivotally connected together on a transverse pivot axis. Each of the handle levers has a forward pivot pin and a rear pivot pin extending parallel to the transverse pivot axis. The transverse pivot axis and the forward and rear pivot pins are normal to the plane of the handle levers. The tool has first and second opposed die cutting jaws connected to the handle levers by engagement of the forward and rear pivot pins for movement toward and away from each other. Each jaw is connected to the forward pivot pin of one handle lever and to the rear pivot pin of the opposite handle lever in corresponding pivot pin receiving openings in each jaw. At least one of the pivot pin receiving openings in each jaw is longitudinally elongated.

The Hartmeister tool also has a pair of guide pins extending between the die cutting jaws and slidable with respect to at least one of the jaws. The pins are spaced apart, each near a forward or rear pivot pin and lying in the plane of the handle levers. The guide pins are approximately in longitudinal alignment with the cutting edges of the jaws.

The guide pins provide for accurate and consistent operation of the jaws as cutting dies. However, when the guide pins need to be replaced for any reason, the tool must be disassembled and the pins forcibly removed from the jaw in which they are rigidly mounted. Further, the use of two guide pins in the plane of the handles requires considerable precision and accuracy in attaching one of the jaw handles to the other.

The Hartmeister tool also has a spring between the die cutting jaws for biasing the jaws apart. The spring is located between the guide pins.

The present invention is a parallel action die cutting hand tool generally of the type described in U.S. Pat. No. 4,272,888 to Hartmeister. In one embodiment of the invention, the guide pins lie outside of and parallel to the plane of the handle levers. The guide pins may be located on the same side of the plane of the handle levers, or on opposite sides of the plane. In each of the first two embodiments, the pins are mounted in guide members removably attached to the cutting jaws.

A third embodiment of the invention has guide pins lying in the plane of the handle levers, and located on opposite sides of the cutting edges. A fourth embodiment of the invention has a single guide pin only. The single guide pin lies in the plane of the handle levers and is located approximately midway between the forward pivot pins and the transverse pivot axis.

BRIEF DESCRIPTION OF THE DRAWINGS

A more complete understanding of the invention can be had by reference to the following Detailed Description when taken in conjunction with the accompanying Drawings, wherein.

DETAILED DESCRIPTION OF THE DRAWINGS

Figure 1:
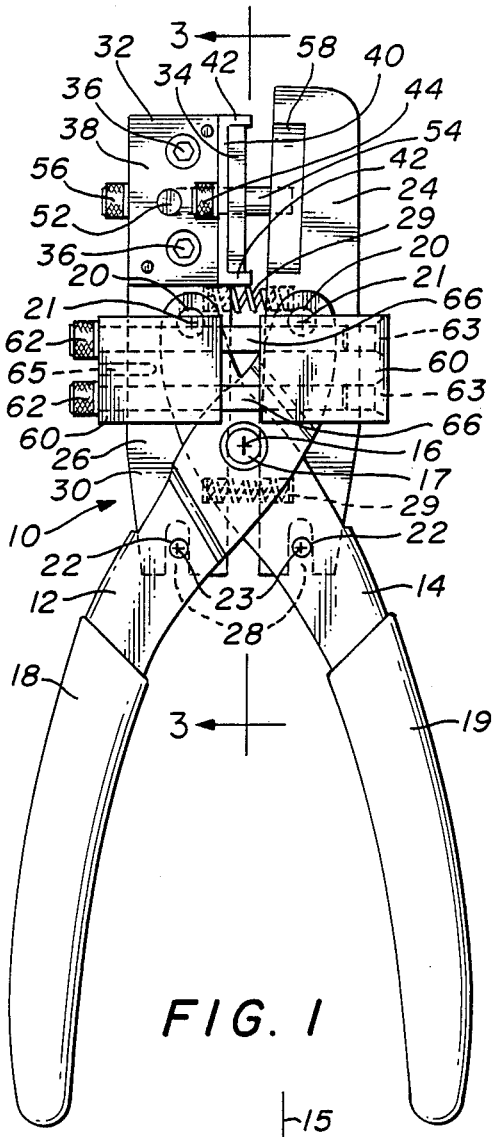
FIG. 1 is a side view of the first embodiment of the trimmer of the invention.
Figure 2:
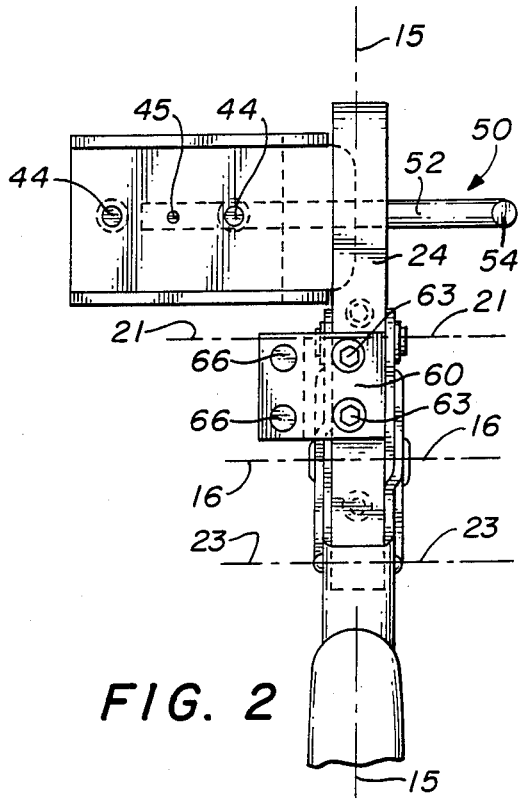
FIG. 2 is a top view of the forward portion of the first embodiment of the trimmer of the invention.

A first embodiment of the invention is shown in FIGS. 1–4. The invention involves a hand-operated parallel action die cutting tool 10 having a first handle lever 12 and a second handle lever 14 pivotally connected together. The handle levers 12 and 14 pivot about a transverse pivot axis 16 through a main pivot pin 17, so that the handle levers 12 and 14 operate in a plane 15 (see FIG. 2). The rearward portions of the handle levers 12 and 14 have hand grips 18 and 19.

Each handle lever 12 and 14 has a forward pivot pin 20 and a rear pivot pin 22. The two forward pivot pins 20 are positioned at a distance forward of the transverse pivot axis 16 and the rear pivot pins 22 are positioned at a distance to the rear of the transverse pivot axis 16. The longitudinal axes 21 and 23 of the forward and rear pivot pins 20 and 22 are parallel to the transverse pivot axis 16 and normal to the plane 15 of the handle levers 12 and 14. The distance from the transverse pivot axis 16 to the forward pivot pins 20 is approximately equal to the distance from the transverse pivot axis 16 to the rear pivot pins 22.

A first or upper die cutting jaw 24 is connected to the first handle lever 12 by forward pivot pin 20 and to the second handle lever 14 by rear pivot pin 22. A second or lower die cutting jaw 26 is connected to the first handle lever 12 by a rear pivot pin 22 and to the second handle lever 14 by a forward pivot pin 20. The rear pivot pins 22 engage the upper and lower jaws 24 and 26 at corresponding pivot pin receiving openings 28. The pin receiving openings 28 are elongated to allow the rear pivot pins 22 to slide with respect to the upper and lower jaws 24 and 26.

When the hand grips 18 and 19 are squeezed, the handle levers 12 and 14 rotate about the transverse pivot axis 16. The forward and rear pivot pins 20 and 22 move in small arcs about the transverse pivot axis 16. As the rear pivot pins 22 slide in the elongated pin receiving openings 28, the upper and lower jaws 24 and 26 move toward one another in parallel straight lines. A pair of resilient compression springs 29 are mounted between the upper and lower jaws 24 and 26. The springs 29 bias the upper and lower jaws 24 and 26 apart.

The lower jaw 26 includes a die base 30, a flat angle support 32, and a die plate 34. The angle support 32 is attached to the die base 30 by means of capscrews 36 threaded through the lower flange 38 of the angle support 32 and into the base 30. The upper flange 40 of the angle support 32 extends laterally and is bounded on its upper edges by ribs 42.

The die plate 34 is attached to the upper flange 40 of the angle support 32 by means of removable fasteners 44. A dowel 45 passes through aligned holes in the upper flange 40 and the die plate 34 to accurately locate the die plate 34 and to add sturdiness to the tool 10.

Figure 3:
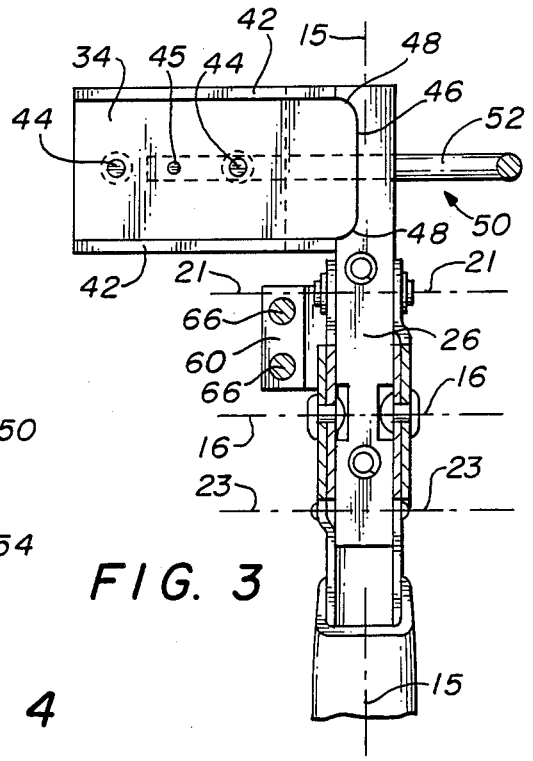
FIG. 3 is a cross-sectional view taken along line 3—3 of FIG. 1.
Figure 4:
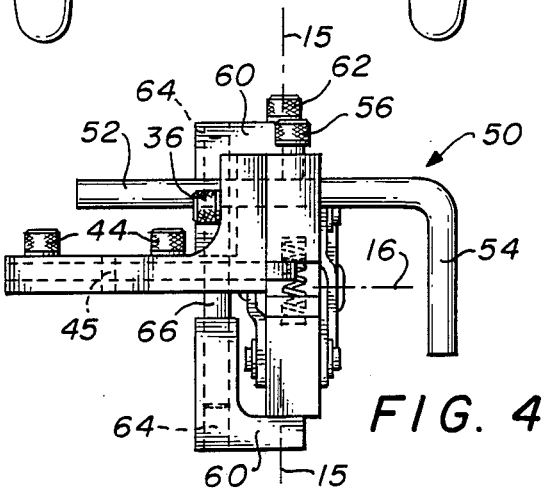
FIG. 4 is a front view of the first embodiment of the trimmer of the invention.

As shown best in FIG. 3, the right hand edge 46 of the die plate 34 extends between the ribs 42 over the top of the base 30. The die plate 34 has curved corners 48 at the transitions between the edge 46 and the ribs 42. The curved corners 48 continue until the corners 48 meet the ribs 42 at a tangent angle of substantially zero degrees.

An L-shaped guide rod 50 having an upright portion 52 and a lower portion 54 is mounted on the tool 10 in order to gauge the amount of the venetian blind slat that is to be trimmed. The lower portion 54 of the guide rod 50 extends through a hole in the lower flange 38 of the angle support 32 and is secured with a fastener 56. The upright portion 52 extends upward beyond the edge 46 of the die plate 34. The position of the guide rod 50 can be adjusted if the fastener 56 is loosened.

The upper jaw 24 has a cooperating die surface 58 that is substantially identical in contour to the lower die edge 46. The upper die surface 58 has a straight portion corresponding to the edge 46 and curved sections corresponding to the corners 48 of the die plate 34.

A guide member 60 is attached to each jaw 24 and 26. The guide member 60 on the lower jaw 26 is attached with a pair of capscrews 62. A dowel 65 extends through the guide member 60 into a hole in the lower jaw 26 to provide additional sturdiness.

A pair of flat head screws 63 are used to attach the other guide member 60 to the upper jaw 24. The flat head screws 63 are used to positively locate the guide member 60, because the upper jaw 24 is heat treated and cannot be drilled for a dowel.

Each guide member 60 has a pair of parallel holes 64 that are aligned with corresponding holes 64 in the other guide member 60. An elongated guide pin 66 is located in each pair of aligned holes 64. The guide pin 66 may be securely attached to one or the other of the guide members 60, but the guide pin 66 is slidable with respect to at least one of the guide members 60. The guide pins 66 are parallel to each other and lie outside of and parallel to the plane of the handle levers 12 and 14. In the embodiment shown in FIGS. 1–4, both guide pins 66 lie on the same side of the handle levers 12 and 14.

In operation, the springs 29 bias the tool 10 in the open position, shown in FIG. 1. A venetian blind slat to be trimmed is placed in the angle support 32 between the ribs 42. The slat is then pushed forward until the end of the slat contacts the upright portion 52 of the guide rod 50. As the handle levers 12 and 14 are squeezed together, the upper and lower jaws 24 and 26 move toward one another. The upper die surface 58 and the die plate 34 cooperate to trim the slat at the edge 46 of the die plate 34. The substantially zero tangent angles of the corners 48 of the die plate 34 form rounded corners on the end of the venetian blind slat. When the handle levers 12 and 14 are released, the springs 29 open the upper and lower jaws 24 and 26. The slat is then removed and replaced with a second slat to be trimmed.

The guide members 60 and the guide pins 66 can be easily replaced, without disassembling the entire tool 10. The fasteners 62 are simply removed from the jaws 24 and 26. New guide members 60 and guide pins 66 are then mounted and secured with the fasteners 62.

Figure 5:
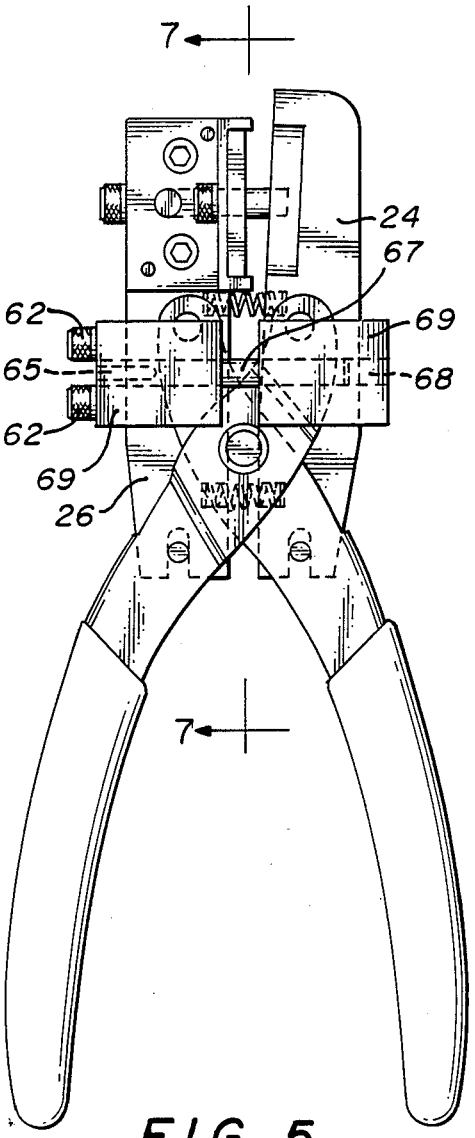
FIG. 5 is a side view of the second embodiment of the trimmer of the invention.
Figure 6:
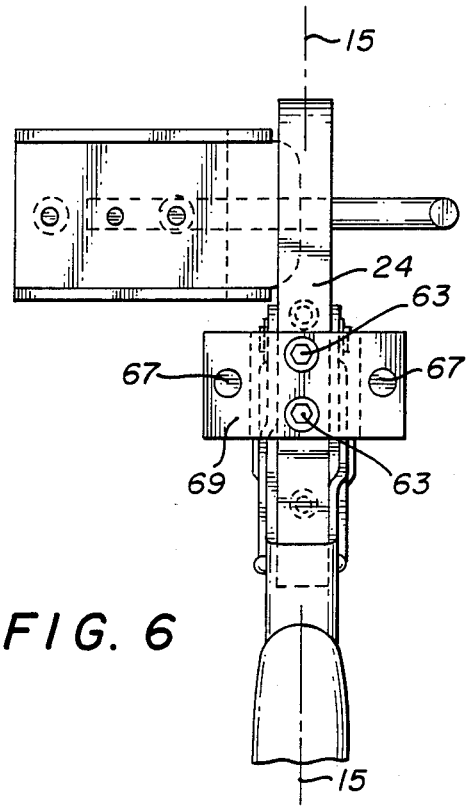
FIG. 6 is a top view of the forward portion of the second embodiment of the trimmer of the invention.
Figure 7:
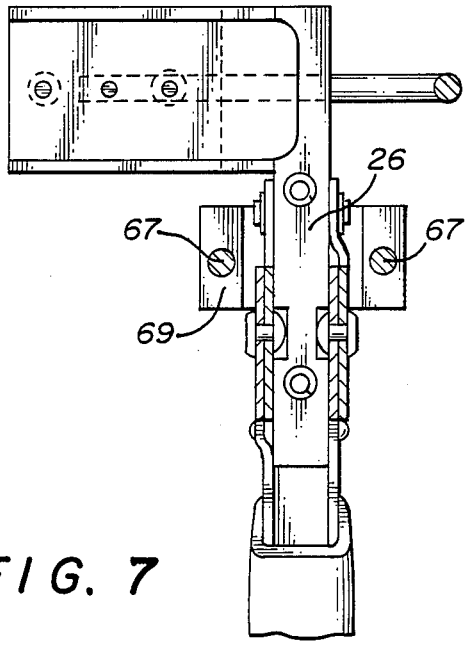
FIG. 7 is a cross-sectional view taken along line 7—7 of FIG. 5.

FIGS. 5–7 show a first alternate embodiment of the tool 10 of the invention. The first alternate embodiment differs from the preferred embodiment in the location of the guide pins 66. In the first alternate embodiment, the elongated guide pins 67 are located on opposite sides of the plane 15 of the handle levers 12 and 14. The guide pins 67 pass through aligned holes 68 in the guide members 69. The guide pins 67 still lie outside of and parallel to the plane 15 of the handle levers 12 and 14.

As in the embodiment shown in FIGS. 1–4, the guide members 69 and guide pins 67 of the first alternate embodiment can be replaced easily. The capscrews 62 and flat head screws 63 are removed from the jaws 24 and 26 to release the old guide members 69 and guide pins 67. New guide members 69 and guide pins 67 are then mounted and secured with the capscrews 62 and flat head screws 63.

Figure 8:
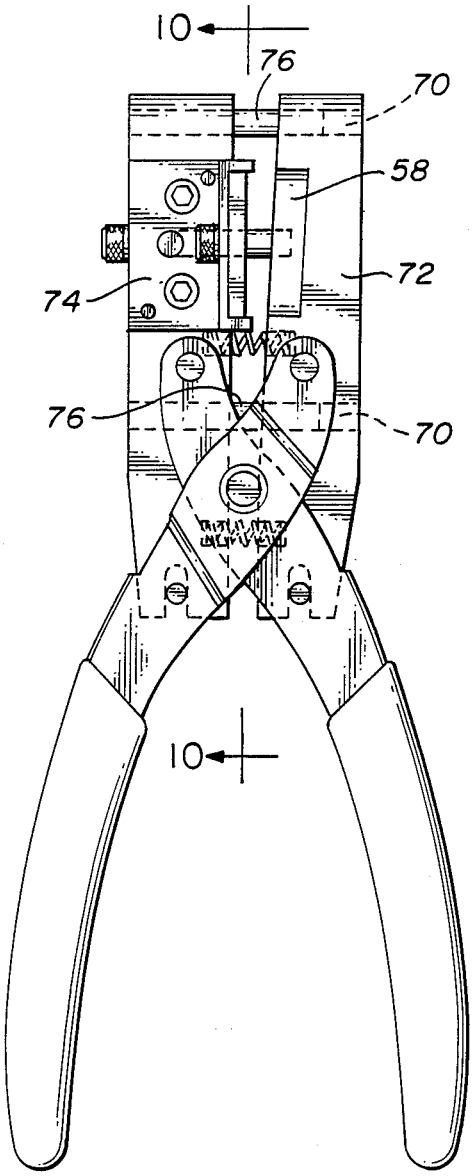
FIG. 8 is a side view of the third embodiment of the trimmer of the invention.
Figure 9:
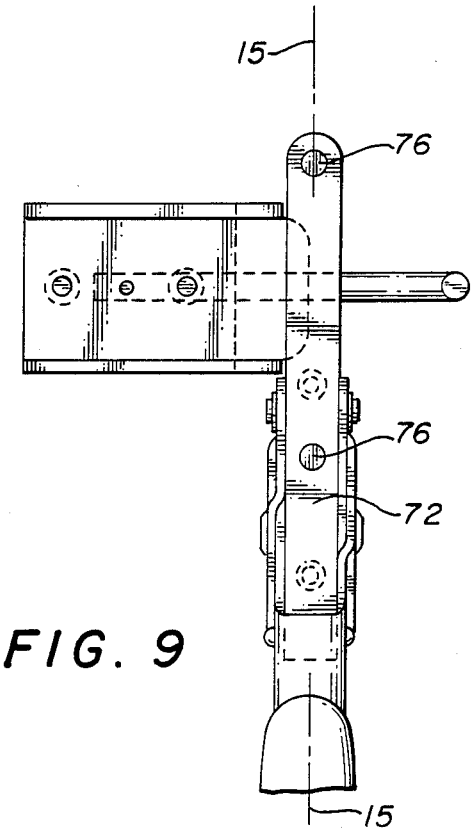
FIG. 9 is a top view of the forward portion of the third embodiment of the trimmer of the invention.
Figure 10:
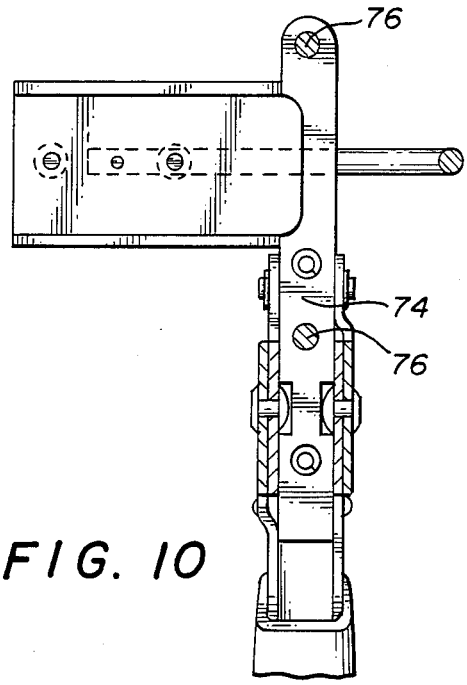
FIG. 10 is a cross-sectional view taken along line 10—10 of FIG. 8.

FIGS. 8–10 show a second alternate embodiment of the invention. The second alternate embodiment does not have guide members corresponding to the guide members 60 of the first embodiment. The guide holes 70 pass directly through the upper and lower jaws 72 and 74. Therefore, the elongated guide pins 76 lie within and parallel to the plane 15 of the handle levers 12 and 14. The two guide pins 76 lie on opposite sides of the cutting edges 46 and 58 of the upper and lower jaws 74 and 76.

Figure 11:
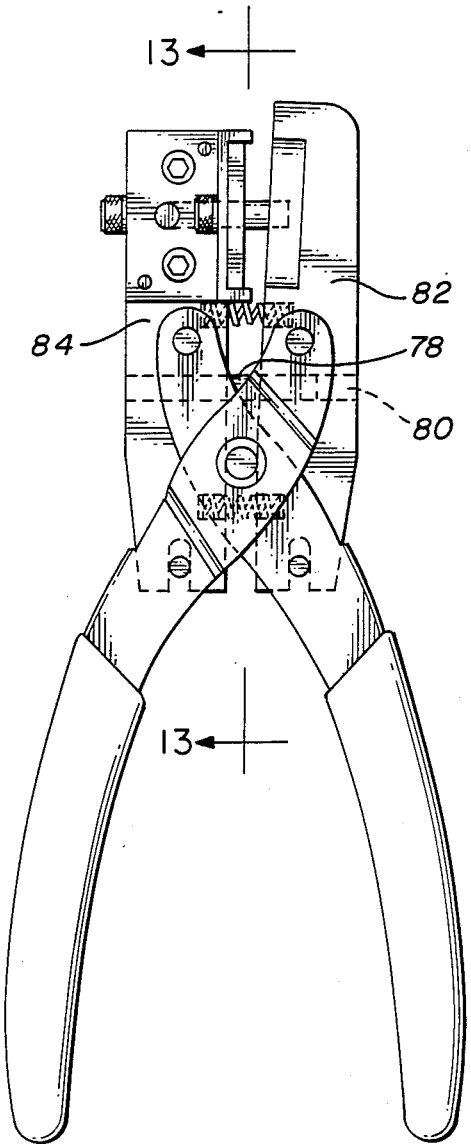
FIG. 11 is a side view of the fourth embodiment of the trimmer of the invention.
Figure 12:
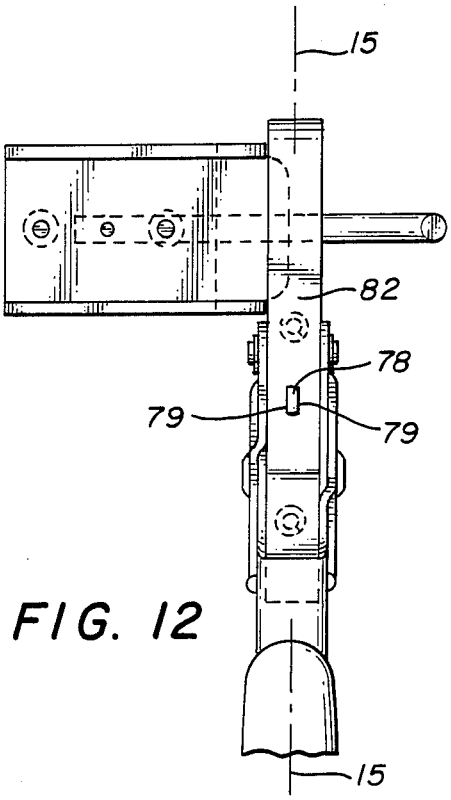
FIG. 12 is a top view of the forward portion of the fourth embodiment of the trimmer of the invention.
Figure 13:
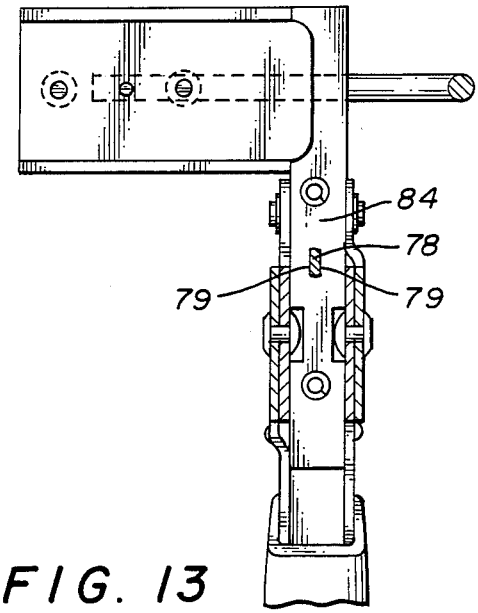
FIG. 13 is a cross-sectional view taken along line 13—13 of FIG. 11.

FIGS. 11–13 show a third alternate embodiment of the invention. In the third alternate embodiment there is a single elongated guide pin 78 only. The single guide pin 78 has flat sides 79 and passes through a guide hole 80 that passes through the upper and lower jaws 82 and 84. The guide pin 78 thus lies in the plane 15 of the handle levers 12 and 14. The guide pin 78 is located approximately midway between the forward pivot pins 20 and the transverse pivot axis 16. The flat sides 79 on the guide pin 78 help prevent the jaws 82 and 84 from rotating with respect to one another during use.

Only the preferred embodiments of the invention have been shown. It should be understood that the invention is not limited to the embodiments disclosed, but is capable of numerous rearrangements, modifications, and substitutions of parts and elements without departing from the spirit of the invention.

I claim:

1. A parallel action die cutting hand tool comprising:

a pair of scissors-action handle levers pivotally connected to each other on a transverse pivot axis, so that the handle levers operate in a plane;

first and second opposed die cutting jaws connected to the handle levers for parallel movement toward and away from each other; and a pair of elongated guide pins rigidly mounted on one of the jaws for slidable movement with respect to the other jaw, the guide pins lying outside of and parallel to the plane of the handle levers.

2. A parallel action die cutting hand tool as recited in claim 1, wherein the two guide pins are located on the same side of the plane of the handle levers.

3. A parallel action die cutting hand tool as recited in claim 1, wherein the two guide pins are located on opposite sides of the plane of the handle levers.

4. A parallel action die cutting hand tool as recited in claim 1, wherein the first die cutting jaw further comprises:

an upper flange extending laterally to the plane of the handle levers and having ribs for positioning a piece to be cut; and a die plate attached to the upper flange between the ribs and having a cutting edge and curved corners between the cutting edge and the ribs, so that the curved corners meet the ribs at a tangent angle of substantially zero degrees.

5. A parallel action die cutting hand tool comprising:

a pair of scissors-action handle levers pivotally connected to each other on a transverse pivot axis, so that the handle levers operate in a plane;

first and second opposed die cutting jaws having cutting edges and connected to the handle levers for parallel movement toward and away from each other; and a pair of parallel guide pins rigidly mounted on one of the jaws on opposite sides of the cutting edges for slidable movement with respect to the other jaw, the guide pins lying in the plane of the handle levers.

6. A parallel action die cutting hand tool comprising:

a pair of scissors-action handle levers pivotally connected to each other on a first transverse pivot axis, so that the handle levers operate in a plane;

first and second opposed die cutting jaws having cutting edges and pivotally connected to the handle levers on second transverse pivots for parallel movement toward and away from each other; and only a single guide pin rigidly mounted on one of the die cutting jaws to one side of the cutting edge between said first and said second pivots for slidable movement with respect to the other jaw, the guide pin lying in the plane of the handle lever.

7. A parallel action die cutting hand tool, comprising:

a pair of scissors-action handle levers pivotally connected to each other on a transverse pivot axis, so that the handle levers operate in a plane;

a forward pivot pin in each of the handle levers positioned forward of the transverse pivot axis and parallel to the transverse pivot axis, the transverse pivot axis and the forward pivot pins being normal to the plane of the handle levers;

a rear pivot pin in each of the handle levers positioned to the rear of the transverse pivot axis, parallel to the transverse pivot axis and normal to the plane of the handle levers;

first and second opposed die cutting jaws connected to the handle levers by engagement of the forward and rear pivot pins for movement toward and away from each other;

means for connecting each jaw to a forward pivot pin of one handle lever and to a rear pivot pin of the opposite handle lever in corresponding pivot pin receiving openings in each jaw, at least one of the pivot pin receiving openings in each jaw being longitudinally elongated; and a pair of guide pins extending between the die cutting jaws and slidable with respect to at least one of the jaws, each pin lying outside of and parallel to the plane of the handle levers.

8. A parallel action die cutting hand tool, comprising:

a pair of scissors-action handle levers pivotally connected to each other on a transverse pivot axis, so that the handle levers operate in a plane;

a forward pivot pin in each of the handle levers positioned forward of the transverse pivot axis and parallel to the transverse pivot axis, the transverse pivot axis and the forward pivot pins being normal to the plane of the handle levers;

a rear pivot pin in each of the handle levers positioned to the rear of the transverse pivot axis, parallel to the transverse pivot axis and normal to the plane of the handle levers;

first and second opposed die cutting jaws having cutting edges and being connected to the handle levers by engagement of the forward and rear pivot pins for movement toward and away from each other;

means for connecting each jaw to a forward pivot pin of one handle lever and to a rear pivot pin of the opposite handle lever in corresponding pivot pin receiving openings in each jaw, at least one of the openings in each jaw being longitudinally elongated; and a single guide pin only extending between the die cutting jaws approximately midway between the forward pivot pins and the transverse pivot axis and slidable with respect to at least one of the jaws, the pin lying in the plane of the handle levers.

* * * * *